United States Patent [19]

Gomoll et al.

[11] Patent Number: 5,067,833

[45] Date of Patent: Nov. 26, 1991

[54] RIBBON SHIFTING DEVICE FOR PRINTERS

[75] Inventors: Guenter Gomoll, Nersingen/Leibi; Wolfgang Hauslaib, Langenau, both of Fed. Rep. of Germany

[73] Assignee: Mannesmann A.G., Duesseldorf, Fed. Rep. of Germany

[21] Appl. No.: 24,419

[22] Filed: Mar. 11, 1987

[30] Foreign Application Priority Data

Mar. 11, 1986 [DE] Fed. Rep. of Germany ..... 3607999

[51] Int. Cl.[5] ..... B41J 35/14

[52] U.S. Cl. ..... 400/213; 400/216

[58] Field of Search ..... 400/211, 212, 213, 213.1, 400/215, 216, 216.1, 216.2, 216.3, 194, 195, 196, 196.1, 207, 208, 208.1, 224, 120

[56] References Cited

U.S. PATENT DOCUMENTS

| | | | |
|---|---|---|---|
| 677,111 | 6/1901 | Brooks | 400/213.1 |
| 2,312,314 | 3/1943 | Bordonaro | 400/213.1 |
| 4,090,600 | 5/1978 | Biedermann | 400/213 |
| 4,132,486 | 1/1979 | Kwan | 400/213 |
| 4,279,522 | 7/1981 | Yonkers | 40/196.1 |
| 4,297,043 | 10/1981 | Dargatz | 400/213.1 X |
| 4,452,542 | 6/1984 | Akazawa | 400/320 X |
| 4,580,917 | 4/1986 | Hibino | 400/120 X |

*Primary Examiner*—David A. Wiecking
*Attorney, Agent, or Firm*—R. H. Siegemund

[57] ABSTRACT

A mono color ink ribbon is held by a pivotable ribbon holder in front of a print head being moved along the platen, and the ribbon holder rides on a rail which has a raised center or central portion and lower ends, so that on a pass by the print head from one end to the other, the ribbon holder is moved up and down over a full cycle. This way, full use is made of the ribbon which is run in a Moebius loop in a cartridge.

6 Claims, 3 Drawing Sheets

RIBBON SHIFTING DEVICE FOR PRINTERS

BACKGROUND OF THE INVENTION

The present invention relates to an ink ribbon device for printers, particularly matrix printers, which include a reciprocating carriage moving along a printing platen and carrying a print head; usually an ink ribbon cartridge is mounted in the frame for the printer, containing an ink ribbon being, for example, held in the cartridge in an endless so-called Moebius loop fashion. A portion of the ribbon extends outwardly from two legs of the cartridge, the legs positioned in-between them, the print head and the platen. Moreover, it is assumed that the ribbon has at least two parallel bands of similar color.

Basically then, these kind of ribbon devices have a ribbon run in a closed loop in order to obtain maximum possible use out of the ribbon, without deterioration of the quality as for as readability of the printed characters are concerned. In case there is just one band, so-to-speak for a single level, the ribbon will be used up fairly rapidly. On the other hand, the ribbon is usually much wider than the height of a character simply for mechanical reasons which amounts to a considerable waste. In this case then, it is of advantage to sub-divide, so-to-speak, the ribbon into two bands. It is therefore necessary to change from one of the bands to the other. If the ribbon is run in a Moebius loop that changeover occurs automatically and does not have to be effected physically, by turning the cartridge over. However, even this approach is not necessarily advantageous because one of the bands always so-to-speak runs along and is not used, while the other portion is being used up but from one side only. It should be realized that the single side concept of a Moebius loop is a mathematical construct. Each band is and continuous to be used from one side only.

The other possibility exists to have a two track or two band ribbon and to subject this ribbon to a wobble motion i.e. to move it up and down so that, in fact, both strips are being used; indeed, that is an added utilization because in a Moebius loop one will use both sides. However, it should be realized that, as a consequence of this wobbling, the ribbon is in fact sinusoidally used and if for some reason there is a "harmonic" relationship between the wobble motion and the ribbon length, there still may be unused ribbon portions, while certain sinusoidal track portions may overlap. This is basically an unforeseeable situation.

DESCRIPTION OF THE INVENTION

It is an object of the present invention to provide a new and improved ink ribbon device for a printers particularly matrix printers, overcoming the problems outlined above;

It is a feature of the present invention to retain the concept of a turn-over of the ribbon without physical turn-over of the cartridge, by continued utilization of the Moebius loop, and to also use the aforementioned wobble motion under observance of a rather shallow angle, as far as emergence of the ribbon from the cartridge is concerned.

In accordance with the preferred embodiment of the present invention, it is suggested to provide a ribbon holder independently from a ribbon cassette which holder is on one hand mounted on the print head carriage but on a side facing away from the print head proper, and being pivotable on an axis that runs parallel to the carriage movement and its rail structure. The ribbon is being paid out of the carriage and prior to reentering it is deflectably run through this ribbon holder; the ribbon holder itself is run and runs on a particular rail that (a) extends parallel to the rail for the carriage which rail (b) spans the distance between the side walls of the printer frame, and (c) exhibits an elevational change from the center towards both ends so that in fact this ribbon holder as holding the ribbon is moved up and down as it runs along its rail while being pivotably held on the print head carriage.

This kind of construction increases the use life of the ribbon, and permits particularly utilization of multi-band ribbons. In addition, durability of the ribbon is actually improved, so is the utilization of its ink content. The ribbon itself is turned over inside of the cartridge and is run and held in the cartridge in a Moebius loop fashion.

In furtherance of the invention, and as a further particularization, it is suggested to curve the rail on which the ribbon holder rides with an apex point in the center. This way then the ribbon gradually rises, so-to-speak, from the exit at the cartridge and is lowered at the end of the respective pass, towards the entrance, and vice-versa on the reverse pass. This, however, is not the only way of configuring the rail. In lieu of a curved rail, the rail may simply have a flat but higher elevation in a central portion and more or less steep transitions towards lower, but also flat portions near both ends. In this case, there is produced a stepwise or rather sinusoidal up and down displacement of the ribbon.

The friction between ribbon holder and its rail occurring on the account of the fact that there is non-linear movement involved can be reduced by having the ribbon holder provided with a roller and it is the roller rather than the holder proper that runs on that rail. The roller may be barrel-shaped to offset lateral movements.

The roller or the holder itself is preferably made of a non-metallic material which has a low friction. In that case, however, an electric static charge may be generated which will be removed by making sure that there is an electric metallic connection between the rail and the usually metallic frame or other metallic parts.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

DETAILED DESCRIPTION OF THE DRAWINGS

Figure 1:
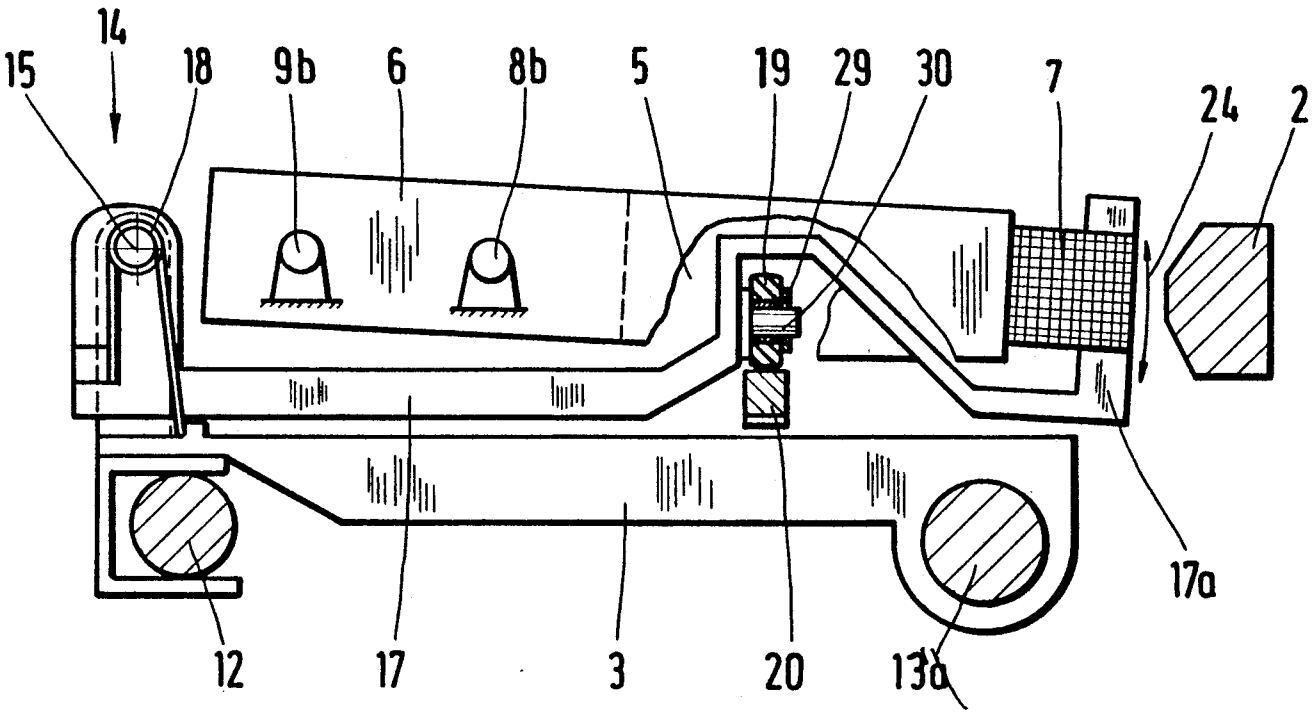
FIG. 1 is a side view of the ribbon device in accordance with the preferred embodiment of the present invention for practicing the best mode thereof.

The figures show the ribbon device generally as can be used in a printer such as a matrix printer. This printer includes a printing platen 2 in front of which is moved, i.e. reciprocated a print head 4. This print head 4 is mounted on a carriage 3 which, in turn, is basically held on and runs on a rail 13. The movement of the carriage and, particularly of the print head, occurs in a space 5 which is, so-to-speak, delineated or encompassed by a ribbon cartridge 6. The cartridge is of a wide U-shaped configuration with a basic body 6*c* and legs 6*a* and 6*b*.

Figure 2:
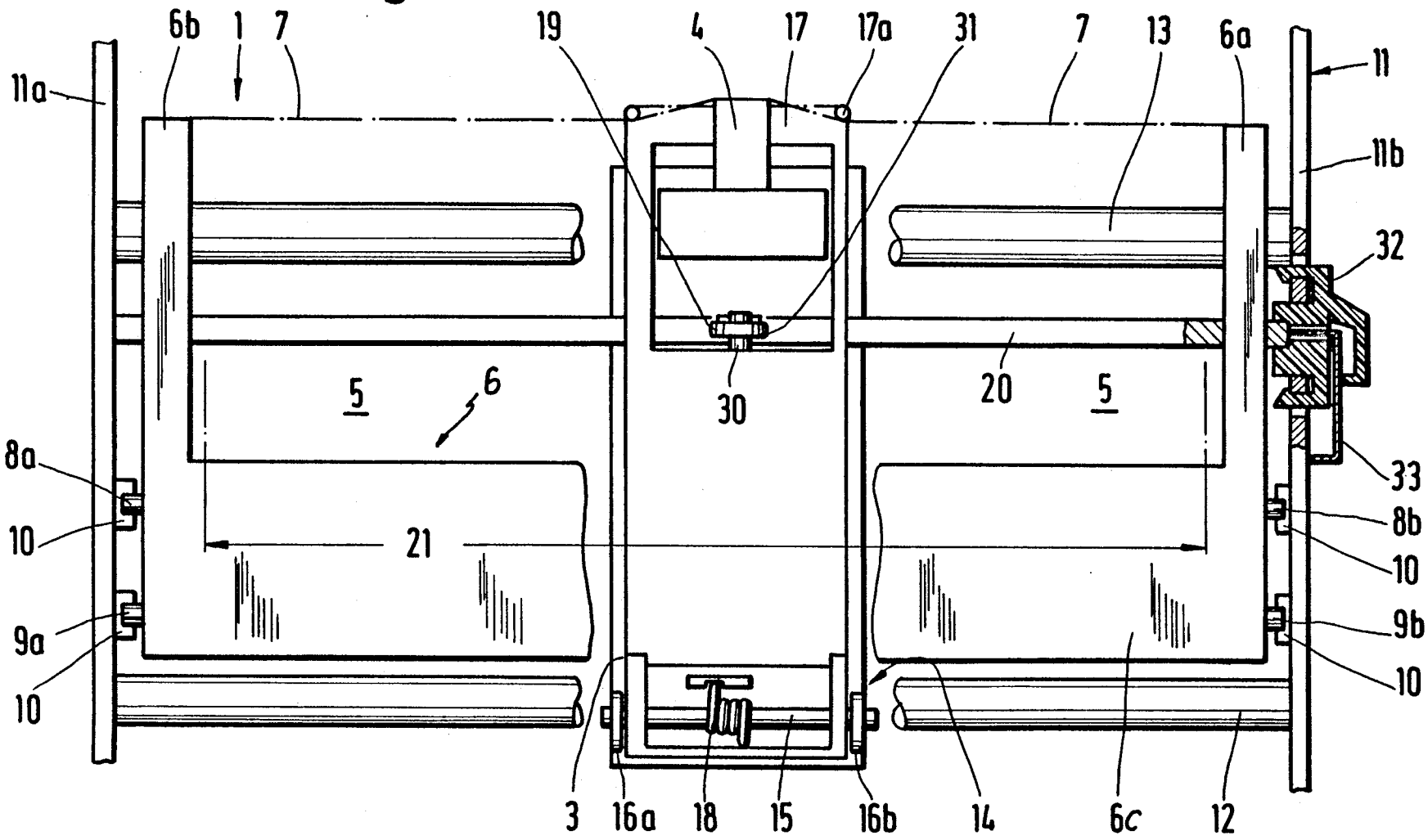
FIG. 2 illustrates the device as shown in FIG. 1 in a top elevation.

The ink ribbon is in some fashion held inside the cartridge 6 and forms a closed loop which is a Moebius loop. The ribbon 7 emerges, as is schematically indicated, for example, in FIG. 2, and also shown FIG. 2 from one of the legs, such as leg 6*b*, and re-enters the cartridge on the other front end of the other leg 6*a*. The cartridge 6, moreover, has pins 9*a* and 9*b* along its side walls for pivoting, if necessary, of the cartridge but a second set of pins, 8*a* and 8*b*, is provided to hold the inserted cartridge in an invariable position. A cartridge of this type is shown in greater detail in our co-pending application, Ser. No. 021,455, filed 03/04/1987). The support members 10 shown in FIG. 2 and somewhat schematically in FIG. 1 are open from above to permit the various pins to slip in and to positively seat them and thereby the cartridge in this frame mount.

The ribbon 7 being stored in this cartridge has at least twice the usual ribbon width or even being four times as wide as conventional ribbons assuming that those conventional ribbons for conventional matrix printers, have at least a minimal width to accommodate 9 styli or print needles of the print head being arranged in a vertical row. The division, so-to-speak, of the ribbon into multi-bands is, of course, a hypothetical one and not in any manner physically represented or manifested, and owing to the fact that it is a single or mono-color ribbon, is, in fact, of uniform configuration.

The print head carriage 3 is mounted for running along the printing platen. For this two parallel rails in terms of round bars 12 and 13 are provided which extend between the frame walls 11 and 11*a* of the printer. The carriage 3 is driven to run along and on these round rail bars in a conventional manner whereby basically a constant speed in both direction is assumed. During these motions of the ribbon is likewise being moved. This movement is usually derived from a particular driven shaft with a key end that is inserted in an appropriate slot or matching key structure of the cartridge, accessible from its outside (not shown and visible), and rollers are provided in the carriage to drive the ribbon. All these aspect are conventional.

In a certain area 14 of the carriage, facing away from the head 3 and the platen 2, a small bar or shaft 15 is held in the carriage 3 by means of two bearings 16*a* and 16*b*, provided for pivoting. The shaft or bar 15 runs parallel to the rails or bars 12 and 13. A ribbon holder 17 is mounted to that bar or shaft 15 which holder guides and holds the ribbon. The holder includes a ribbon holder frame 17*a* being situated close to the print elements (mouth piece) of print head 4. The ribbon holder 17, when made of a synthetic material, will, in fact, be of very light weight. Holder 17, biased for pivoting by means of a spring 18, acting in a direction towards the carriage rail or bar 13. The holder 17, moreover, is provided with a roller 19 and by means of that holder 17 is held on and bears against a particular rail 20. Rail 20 extends between the same side walls 11*a* and 11*b* of the frame 11.

The print head carriage 3 is movable basically over, at least for the distance or length 21, for a particular printing pass. The rail 20 has a center 22 and, generally speaking, that center point is the high point of the rail which droops towards side walls 11*a* and 11*b*, there being, generally, a level difference 23. Hence, as a carriage 3 reciprocates along the platen, the ribbon holder 17 and particularly the frame 17*a* is moved up and down to a degree dependent upon the level variations (23) of the rail 20 from both sides from the center of the rail 20.

Figure 3:
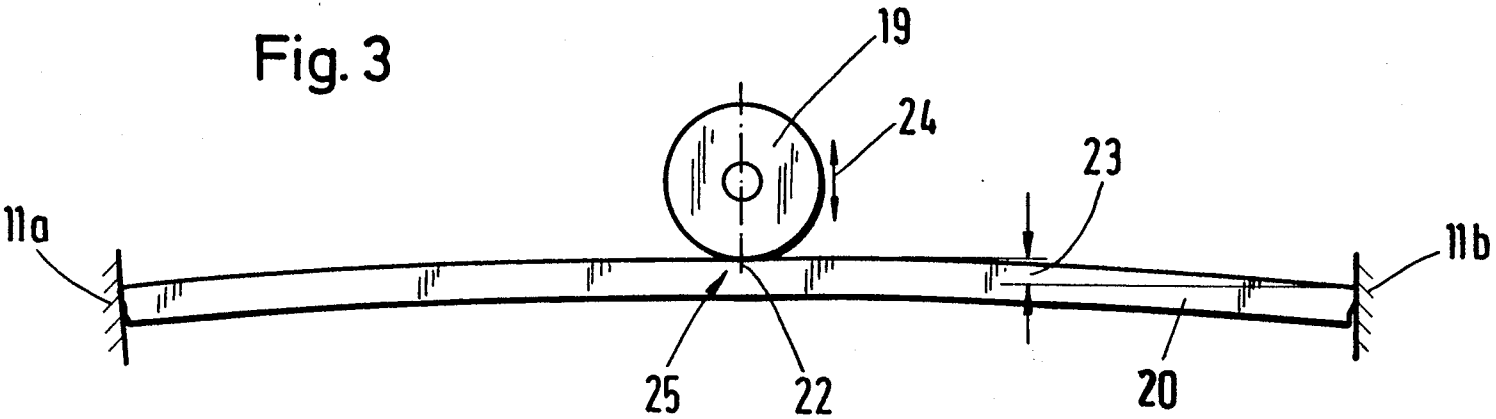
FIG. 3 illustrates a first example for a rail construction to be used in a device shown in FIGS. 1 and 2.

Turning to FIG. 3, a particular configuration for the rail 20 is shown, as it extends between the side walls 11*a* and 11*b*. Here, the rail is basically of a curved formation with an apex of the curved configuration constituting a peak in the center of the rail. The rail droops down gradually towards the side walls 11*a* and 11*b*. Consequently, the ribbon holder 17 will undergo a complete up and down cycle during one pass in a sinusoidal or near sinusoidal fashion. This movement is a continuous one and reverses in the apex point as well as when the carriage reverses on either end.

Figure 4:
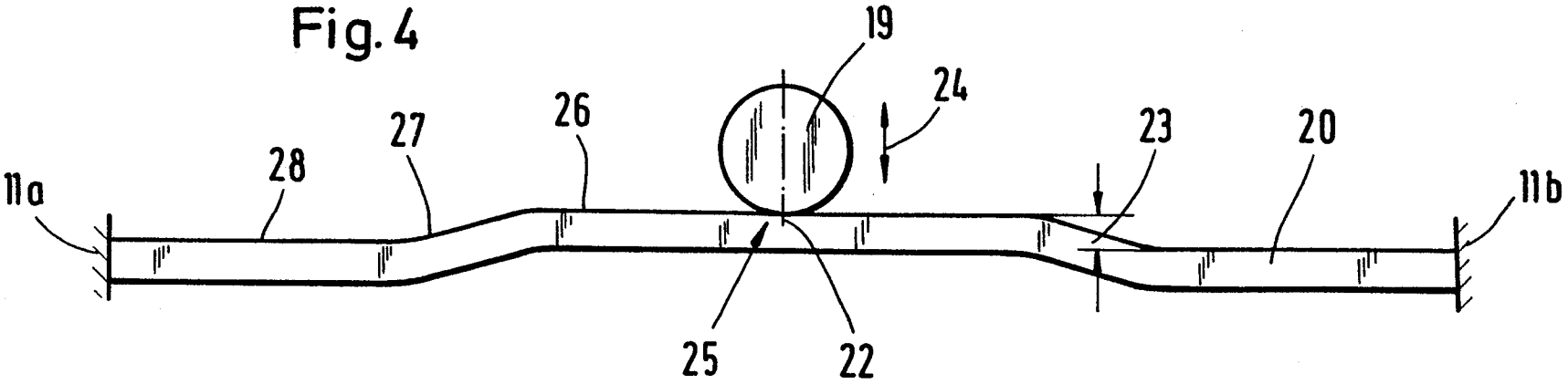
FIG. 4 illustrates a second rail configuration for the same task.

In accordance with another embodiment shown in FIG. 4, the rail is constructed to have a flat central part of a relative high dimension, rather steep transitions 27 merging into uni-level portions 28 on either end. In this case then, and as the print head moves along the platen from one end to the other, the level remains constant for awhile, changes rather rapidly corresponding to the fairly steep rise of a transition 27 and then remains constant as a carriage passes a mid-point. On continuing, the movement reverses.

It can be seen that in each of these cases, the ribbon holder undergoes an up and down movement; no matter what the contour of that movement is, it encompasses a full cycle. Particularly, in the case of FIG. 4, it can, for example, be interpreted as follows. The rail is a means to adjust the position of the ribbon 7 in some correspondence to the distribution of frequency of print hammer (or styli or other print element) actuation. The adjustment is transverse to the longitudinal movement of the ribbon. This way, one will, in fact, use the entire width of the ribbon in the course of operation.

The roller 19 diminishes a friction as far as traveling of the holder 17 on the rail or bar 20 is concerned. The roller 19 is journalled in the ribbon holder 17, there being a stationary bearing 29 and receiving a journalling pin 30. In order to reduce the friction of the roller 19 further, it may be barrel-shaped, as can be seen particularly in FIG. 2, as far the outer periphery 31 is concerned.

Nevertheless, there is some residual friction. That friction will cause the frame 11 to be electro-statically charged. This means that the resulting charge has to be conducted out of the system which, in turn, means that the frame of the printer or any other part that is electrically conductively connected to the frame, is grounded through a null conductor or the like in order to protect the user of the printer.

The rail or bar 20 is mounted in the side walls 11*a* and 11*b* in an exact position under utilization of caps 32 made of synthetic material. However, a metallic conductor 33 by-passes at least one of the caps and directly electrically interconnects the metallic rail/bar 20 with a metallic side walls 11*a* and 11*b*, thereby establishing a definite current path just immediately, directly and continuously effective to remove any electric charge from the print head and the carriage, and thereby reducing any high voltage. The current flow is inevitably quite small.

The invention is not limited to the embodiments described above but all changes and modifications thereof, not constituting departures from the spirit and scope of the invention are intended to be included.

We claim:

1. A ribbon device for a printer which includes a print head mounted on a carriage, said carriage reciprocating on rail means along and parallel to a printing platen, the platen as well as the rail means being held in opposite side walls of a printer frame or the like, there being a ribbon cartridge defining and establishing a space within which said print head can move and paying the ribbon such that the ribbon is placeable between the print head and the platen during printing, the combination comprising:

said ribbon forming a closed Moebius loop;

a ribbon holder for holding the ribbon in front of the print head and being pivotally mounted on a pivot axis on the carriage, the pivot axis extending parallel to said platen and to said direction of reciprocating movement and being situated on the carriage at an area away from the print head;

particular rail means mounted between said printer frame side walls and extending generally parallel to said platen, said pivot axis and said carriage rail means, and being located between the pivot axis and the platen, said particular rail means being contoured to have a higher elevation in a central portion than in portions more adjacent to said side walls; and said ribbon holder being provided with low friction means riding on said particular rail means so that upon reciprocating of said carriage and passage of the print head along a platen, the ribbon holder moves up and down in one full cycle when moving from end to end.

2. The ribbon device as in claim 1, wherein said particular rail means is of curved configuration with a high point in the center of the particular rail means.

3. The ribbon device as in claim 1, wherein said particular rail means has straight end portions and a straight central portion, and transitions from a higher to a lower level in between the center and the straightened portions.

4. The ribbon device as in claim 1, wherein said low friction means is a roller running on said particular rail means, thereby providing low friction support of the ribbon holder on the particular rail means.

5. The ribbon device as in claim 1, said low friction means being a barrelshape roller.

6. The ribbon device as in claim 1, said frame being a metallic frame, the device further including a electrical current conductive connection between the particular rail means and said metallic frame.

* * * * *